US006117053A

United States Patent [19]

Chiu

[11] Patent Number: 6,117,053

[45] Date of Patent: Sep. 12, 2000

[54] TREAD BOARD ASSEMBLY FOR A TREADMILL EXERCISE MACHINE

[76] Inventor: Rody Chiu, 12th Fl.-5, No. 764, Ta Tun Rd., Nan Tun Dist., Taichung, Taiwan

[21] Appl. No.: 09/027,540

[22] Filed: Feb. 23, 1998

[30] Foreign Application Priority Data

Sep. 18, 1997 [TW] Taiwan ..... 86215864

[51] Int. Cl.[7] ..... A63B 22/02

[52] U.S. Cl. ..... 482/54; 482/51

[58] Field of Search ..... 482/51, 54

[56] References Cited

U.S. PATENT DOCUMENTS 5,913,384 6/1999 Williams ..... 482/54

*Primary Examiner*—Glenn E. Richman

*Attorney, Agent, or Firm*—Patterson, Thuente & Skaar

[57] ABSTRACT

A tread board assembly for a treadmill exercise machine includes a supporting bracket, an energy return and shock absorption body fixedly mounted on the supporting bracket, and a slide assistant layer fixedly mounted on the energy return and shock absorption body.

12 Claims, 6 Drawing Sheets

TREAD BOARD ASSEMBLY FOR A TREADMILL EXERCISE MACHINE

FIELD OF THE INVENTION

The present invention relates to a tread board assembly, and more particularly to a tread board assembly for a treadmill.

BACKGROUND OF THE INVENTION

A conventional treadmill exercise machine is shown in FIG. 9, and an illustration will follow in the detailed description of the preferred embodiments.

The present invention has arisen to mitigate and/or obviate the disadvantage of the conventional treadmill.

SUMMARY OF THE INVENTION

In accordance with one aspect of the present invention, there is provided a tread board assembly for a treadmill exercise machine comprising a supporting bracket, an energy return and shock absorption body fixedly mounted on the supporting bracket, and a slide assistant layer fixedly mounted on the energy return and shock absorption body.

Further features of the present invention will become apparent after a careful reading of the detailed description with appropriate reference to the accompanying drawings.

DETAILED DESCRIPTION OF THE PREFERRED EMBODIMENTS

Figure 9:
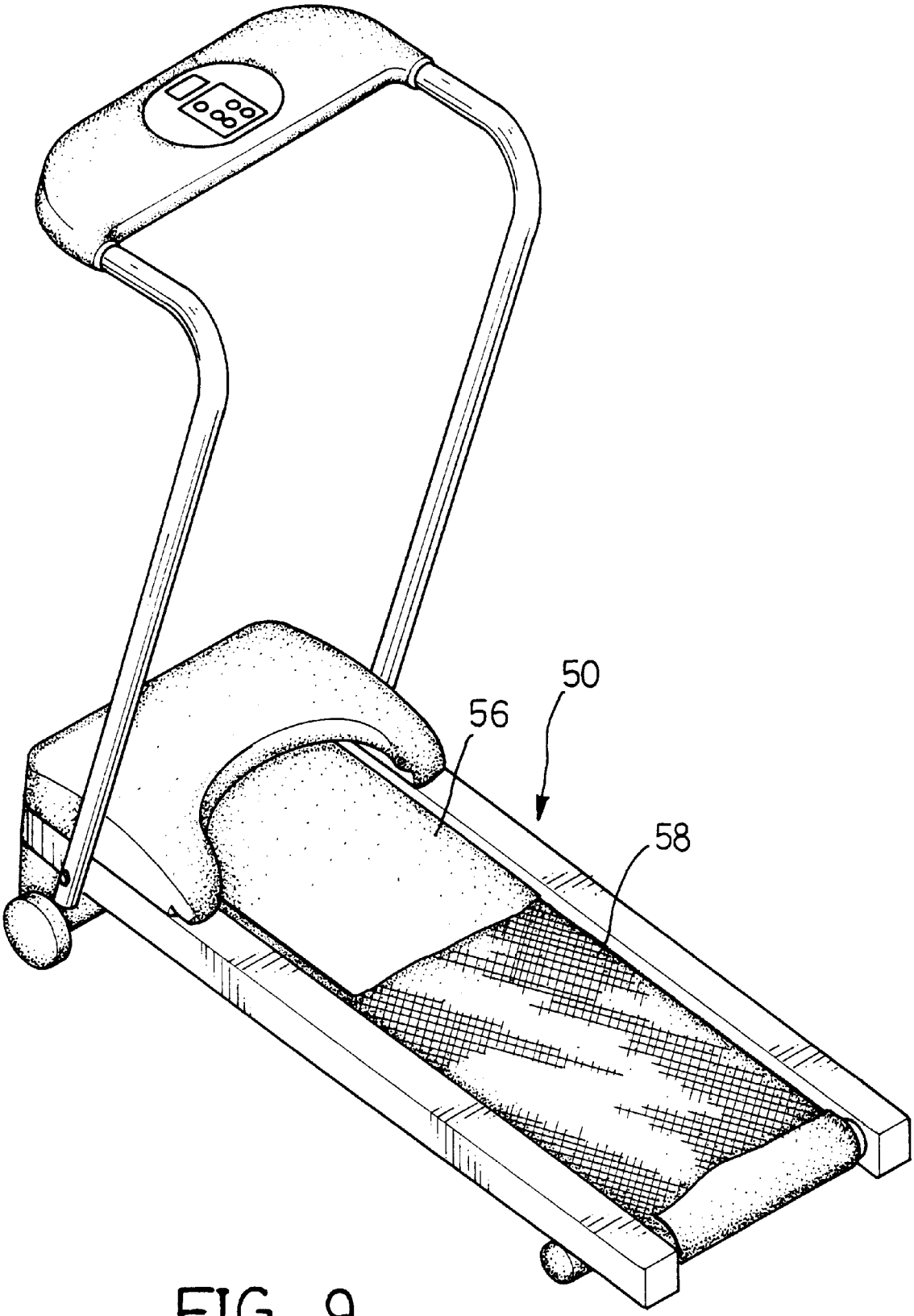
FIG. 9 PRIOR ART
FIG. 9 is a partially cut-away perspective view of a conventional treadmill exercise machine in accordance with the prior art.

For a better understanding of features and benefits of the present invention, reference is now made to FIG. 9, illustrating a conventional treadmill exercise machine in accordance with the prior art.

The conventional treadmill exercise machine comprises a supporting frame 50 made of a hard material, a tread board 58 fixedly mounted in the supporting frame 50, and a running belt 56 rotatably mounted in the supporting frame 50 and reeved around the tread board 58.

By such an arrangement, however, an impact or shock will be directly transmitted to a user from the tread board 58 when running, thereby easily doing damage to the user. In addition, noise is easily created during a user running on the treadmill due to a direct contact between the running belt 56 and the tread board 58. Further, the running belt 56 and the tread board 58 are easily worn out due to a great friction therebetween during long-term utilization.

Figure 1:
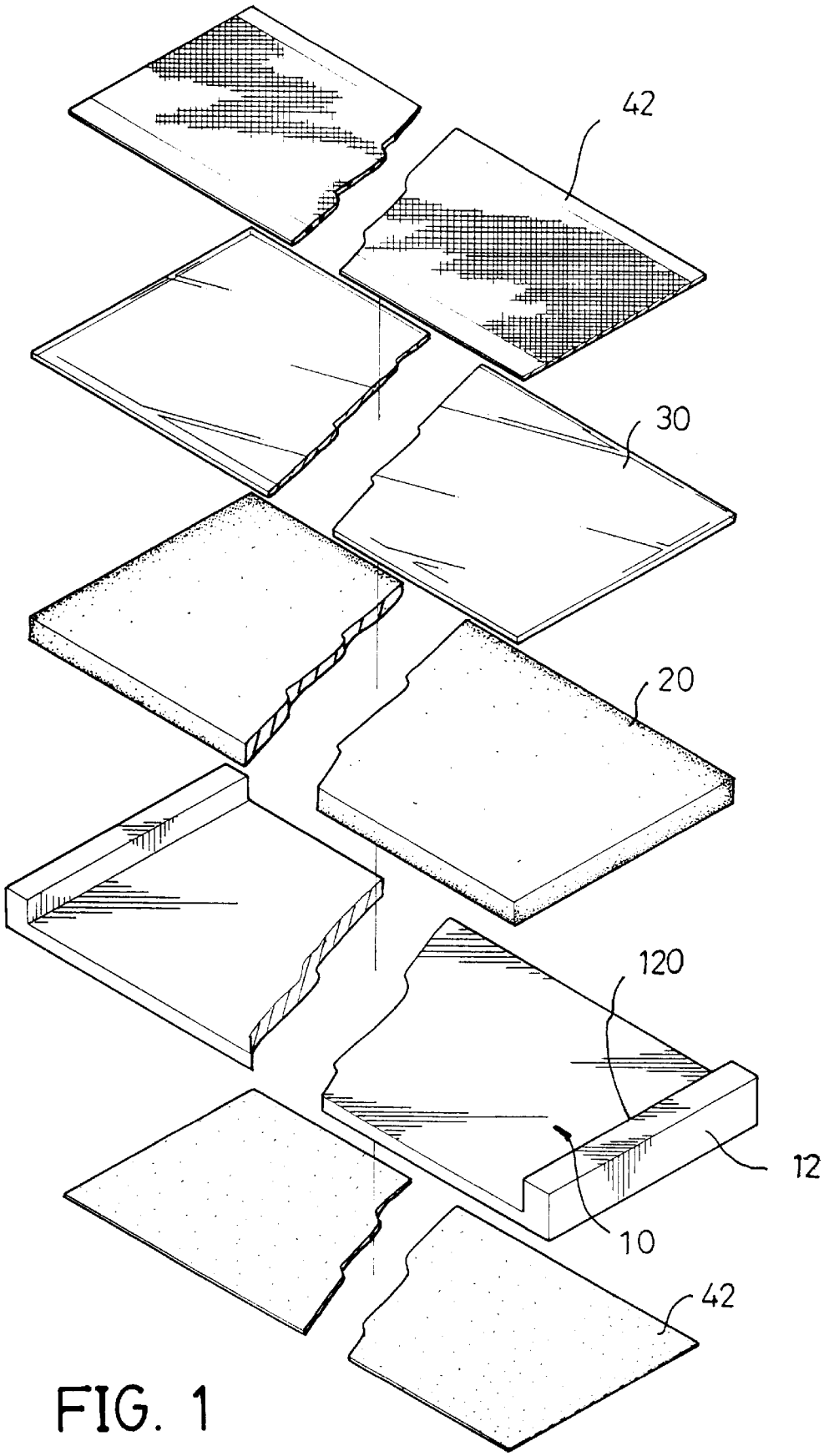
FIG. 1 is an exploded view of a tread board assembly for a treadmill exercise machine in accordance with a first embodiment of the present invention.
Figure 2:
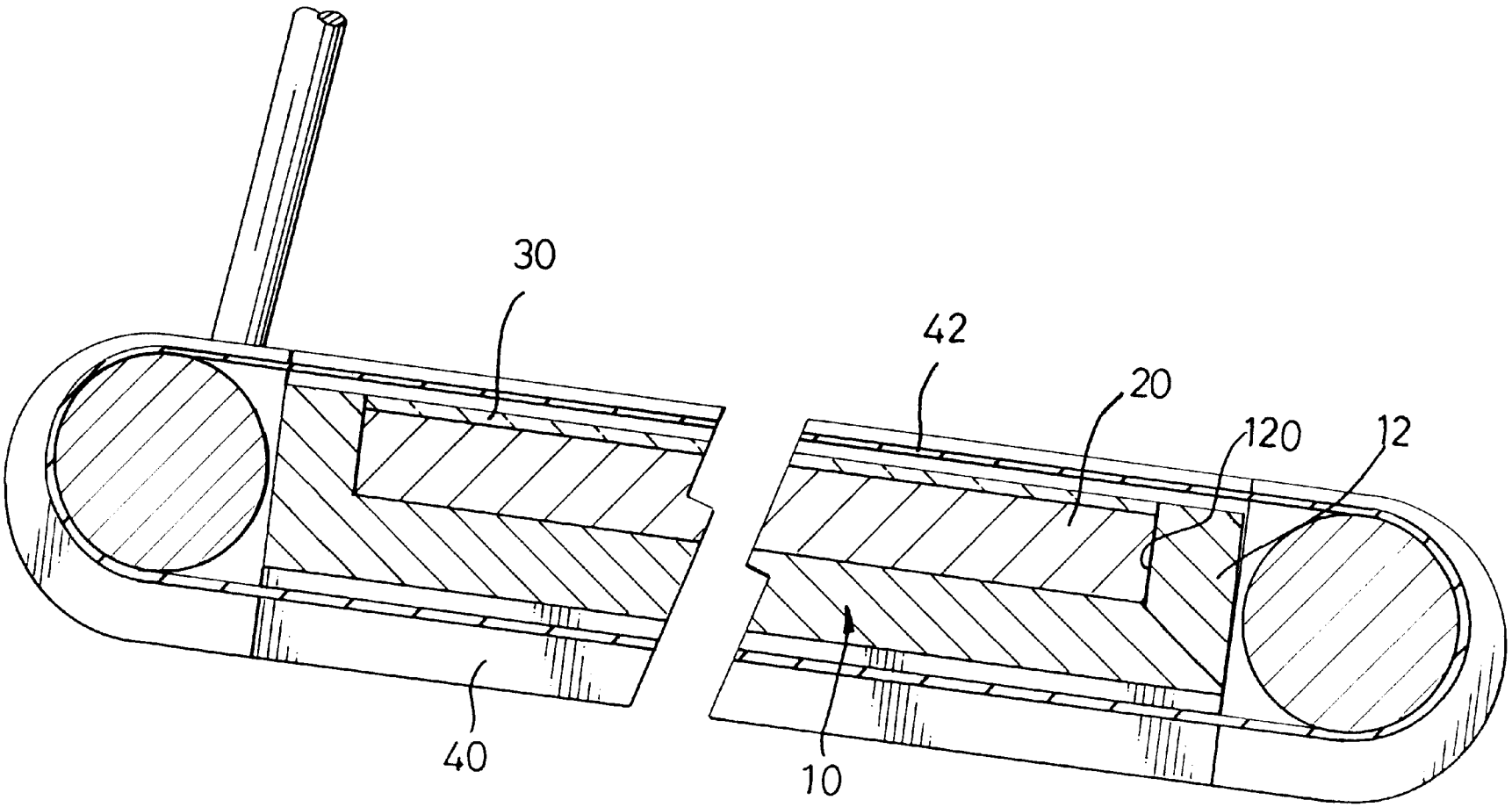
FIG. 2 is a front plan cross-sectional assembly view of the tread board assembly shown in FIG. 1.
Figure 3:
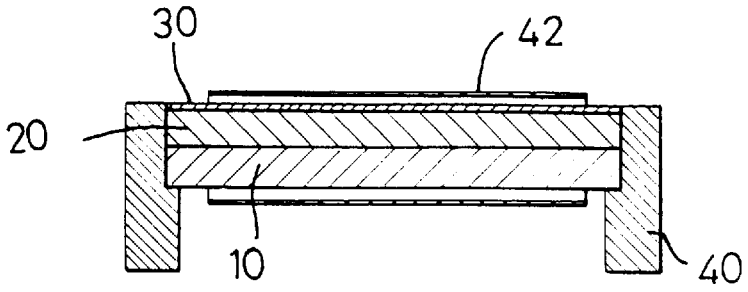
FIG. 3 is a side cross-sectional assembly view of the tread board assembly shown in FIG. 1.

Referring to the remaining drawings, and initially to FIGS. 1–3, a tread board assembly according to the present invention can be adapted for a treadmill exercise machine which comprises a frame 40, and a loop-shaped running belt 42 reeved around the frame 40.

The tread board assembly comprises a supporting bracket 10 made of a hard material fixedly mounted in the frame 40, an energy return and shock absorption body 20 fixedly mounted on the supporting bracket 10 for providing a cushioning effect to a user, and a slide assistant layer 30 fixedly mounted on the energy return and shock absorption body 20 and located beneath the running belt 42 for providing an effect to decrease friction between the running belt 42 and the energy return and shock absorption body 20.

The supporting bracket 10 includes two distal end portions each formed with an upright lug 12, thereby defining a receiving recess 120 therebetween for receiving and retaining the energy return and shock absorption body 20 and the slide assistant layer 30 therein.

The energy return and shock absorption body 20 is preferably made of a foamable material such as polyurethane (P.U.), ethyl vinyl acetate (E.V.A.), rubber or the like.

The slide assistant layer 30 is preferably made of a wear-resistant material with a low friction coefficient such as poly carbonate (P.C.), poly propylene (P.P.), polyvinyl chloride (P.V.C.) or the like.

In addition, the slide assistant layer 30 can be made of a transparent material.

By such an arrangement, the energy return and shock absorption body 20 can be adapted to absorb impact and shock emanating from the supporting bracket 10 to the user when running thereon, thereby achieving a cushioning effect so as to reduce the injury-causing impact on the user. In addition, the energy return and shock absorption body 20 can be adapted to decrease noise created by the supporting bracket 10 during running. Further, the slide assistant layer 30 can be adapted to decrease the friction between the running belt 42 and the energy return and shock absorption body 20, thereby preventing the energy return and shock absorption body 20 from being worn out during long-term utilization.

Figure 4:
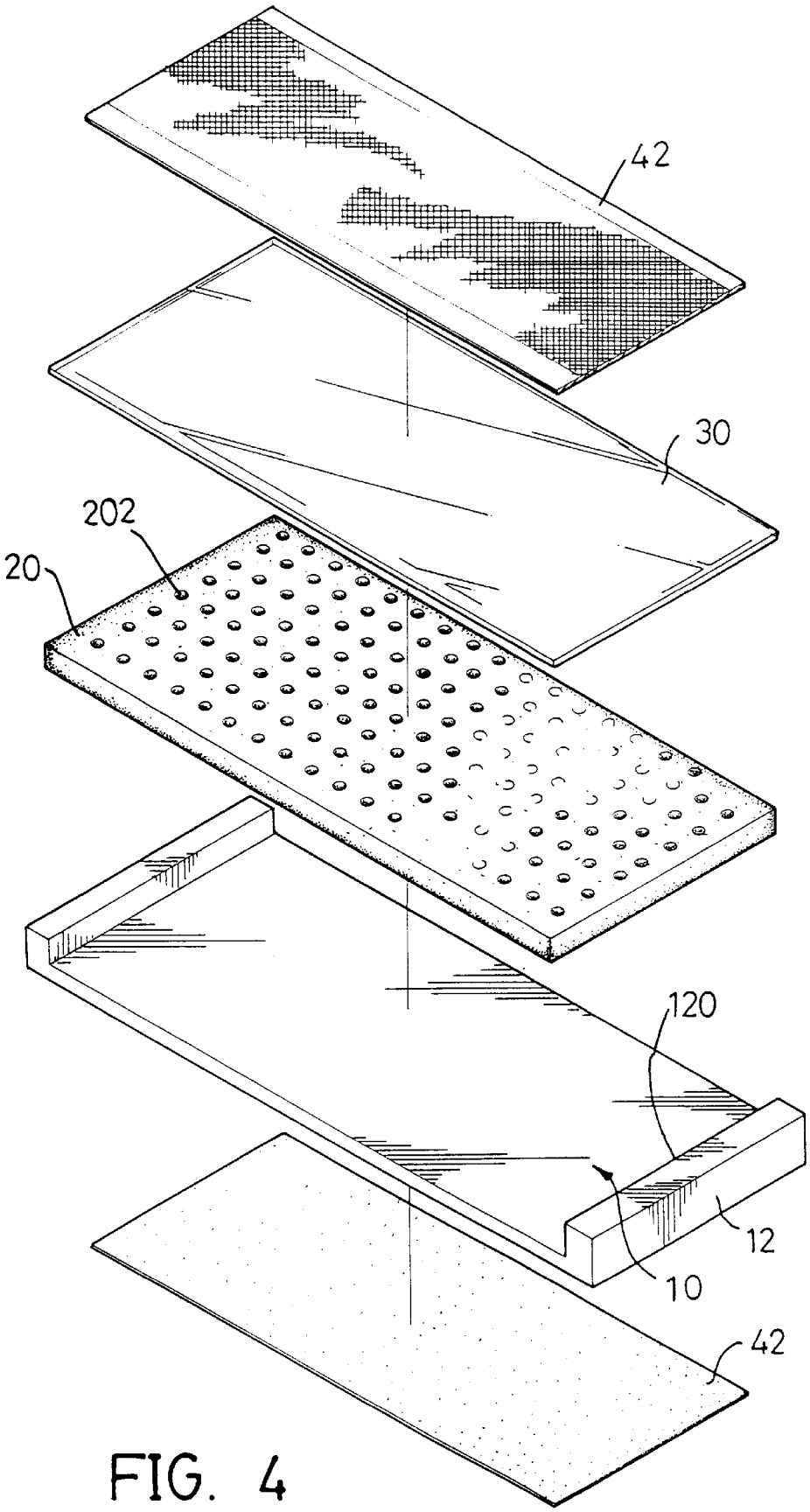
FIG. 4 is an exploded view of a tread board assembly for a treadmill exercise machine in accordance with a second embodiment of the present invention.

Referring now to FIG. 4, in accordance with a second embodiment of the present invention, the energy return and shock absorption body 20 defines a plurality of recesses 202 therein.

Figure 5:
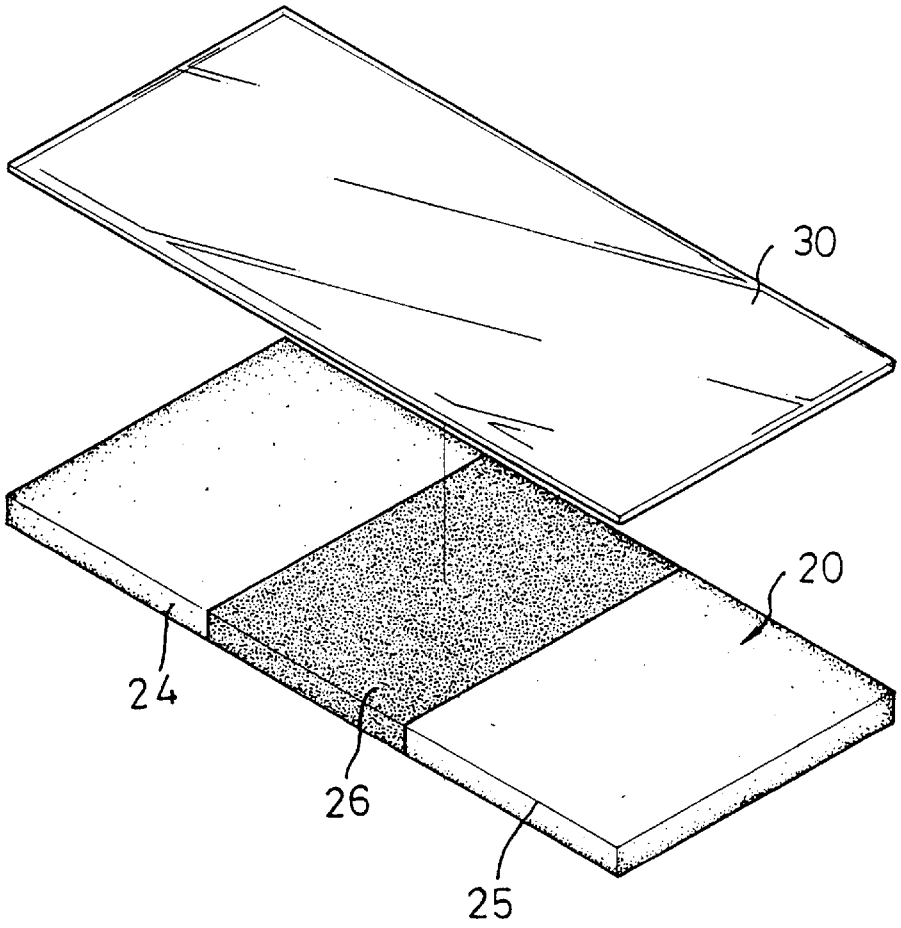
FIG. 5 a perspective view showing an energy return and shock absorption body and a slide assistant layer.

Referring now to FIG. 5, the energy return and shock absorption body 20 comprises a plurality of elastic cushions 24, 25, 26 made of different material and juxtaposed with each other.

Figure 6:
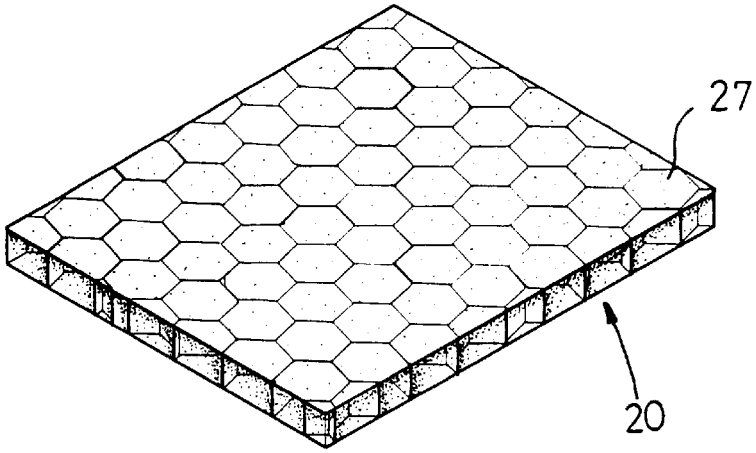
FIG. 6 a perspective view of an energyy return and shock absorption body.

Referring now to FIG. 6, the energy return and shock absorption body 20 has a honeycomb shape and comprises a plurality of hexagonal elastic cushions 27.

Figure 7:
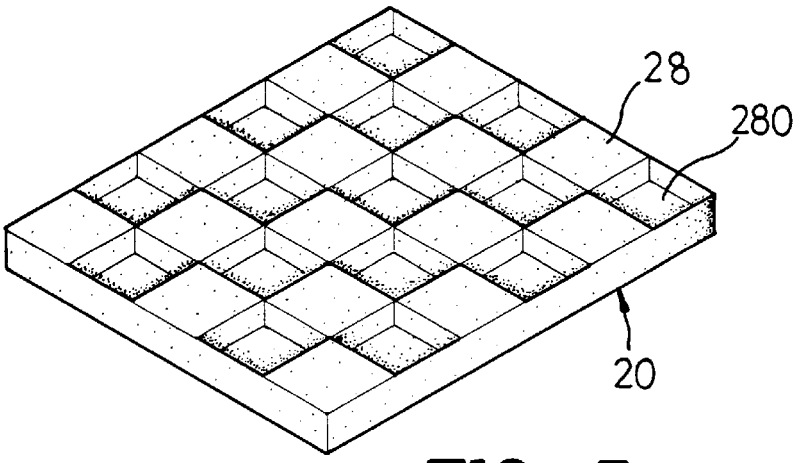
FIG. 7 a perspective view of an energy return and shock absorption body.

Referring now to FIG. 7, the energy return and shock absorption body 20 comprises a plurality of square elastic cushions 28 and a plurality of recessed portions 280 arranged in an alternating manner with each other.

Figure 8:
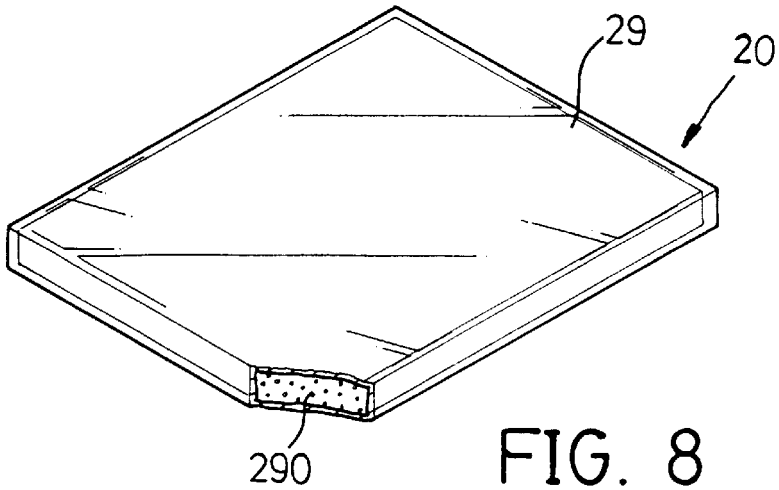
FIG. 8 a perspective view of an energy return and shock absorption body.

Referring now to FIG. 8, the energy return and shock absorption body 20 comprises an elastic coating 29 made of thermoplastic polyurethane (T.P.U.) elastomer, and a cushion 290 made of silica gel received in the elastic coating 29.

It should be clear to those skilled in the art that further embodiments may be made without departing from the scope and spirit of the present invention.

What is claimed is:

1. A tread board assembly for a treadmill exercise machine comprising:

a supporting bracket (10) including two distal end portions each formed with an upright lug (12), thereby defining a receiving recess (120) therebetween;

an energy return and shock absorption body (2) fixedly mounted in said receiving recess (120) of said supporting bracket (10);

a slide assistant layer (30) fixedly mounted on said energy return and shock absorption body (20); and an endless running belt looped around said slide assistant layer.

2. The tread board assembly in accordance with claim 1, wherein said energy return and shock absorption body (20) is made of a foamable material.

3. The tread board assembly in accordance with claim 2, wherein said energy return and shock absorption body (20) is made of polyurethane.

4. The tread board assembly in accordance with claim 1, wherein said energy return and shock absorption body (20) is made of ethyl vinyl acetate.

5. The tread board assembly in accordance with claim 1, wherein said energy return and shock absorption body (20) defines a plurality of recesses (202) therein.

6. The tread board assembly in accordance with claim 1, wherein said energy return and shock absorption body (20) comprises a plurality of elastic cushions (28) and a plurality of recessed portions (280) arranged in an alternating manner with each other.

7. The tread board assembly in accordance with claim 1, wherein said slide assistant layer (30) is made of a material with a low friction coefficient.

8. The tread board assembly in accordance with claim 1, wherein said slide assistant layer (30) is made of a wear-resistant material.

9. The tread board assembly in accordance with claim 1, wherein said slide assistant layer (30) is made of poly carbonate.

10. The tread board assembly in accordance with claim 1, wherein said slide assistant layer (30) is made of poly propylene.

11. The tread board assembly in accordance with claim 1, wherein said slide assistant layer (30) is made of polyvinyl chloride.

12. The tread board assembly in accordance with claim 1, wherein said slide assistant layer (30) is transparent.

* * * * *